United States Patent [19]

Sapkus et al.

[11] 4,424,644

[45] Jan. 10, 1984

[54] WINKING APPARATUS FOR FIGURE TOY

[75] Inventors: Jurgis Sapkus; Charles D. Clarke, both of Manhattan Beach; J. Stephen Lewis, Pacific Palisades; James P. Mills-Winkler, Torrance, all of Calif.

[73] Assignee: Mattel, Inc., Hawthorne, Calif.

[21] Appl. No.: 232,072

[22] Filed: Feb. 6, 1981

[51] Int. Cl.[3] ..... A63H 3/48

[52] U.S. Cl. ..... 46/135 R; 46/164

[58] Field of Search ..... 46/168, 135 R, 118

[56] References Cited

U.S. PATENT DOCUMENTS

| | | | |
|---|---|---|---|
| 503,967 | 8/1983 | Holland | 46/166 |
| 2,565,603 | 8/1951 | Fraysur | 46/118 |
| 2,616,216 | 11/1952 | Fraysur | 46/120 |
| 2,660,830 | 12/1953 | Jentzen | 46/135 |
| 2,686,388 | 8/1954 | Seidl | 46/135 R X |
| 2,688,208 | 9/1954 | Bannister | 46/166 X |
| 3,086,318 | 4/1963 | Brudney | 46/166 |
| 3,699,707 | 10/1972 | Sapkus | 46/166 |
| 3,881,275 | 5/1975 | Baulard-Cogan | 46/135 R X |
| 3,916,561 | 11/1975 | Kato | 46/118 |
| 3,924,351 | 12/1975 | Terzian | 46/118 |
| 4,158,931 | 6/1979 | Terzian | 46/118 |
| 4,223,561 | 9/1980 | Guerrero | 74/105 |

*Primary Examiner*—F. Barry Shay

*Attorney, Agent, or Firm*—Ronald M. Goldman; Max E. Shirk; James G. O'Neill

[57] ABSTRACT

A winking apparatus (10 ) includes a doll head (20) having an eye (38) provided on an outer surface thereof beneath an arcuate slot (40) in which an eyelid (42) is movably mounted by an eye-lid-mounting mechanism (52) pivotally mounted in head (20) and actuatable by an actuating mechanism (60) to impart winking motions to eyelid (42).

1 Claim, 3 Drawing Figures

10
42
56
106
52
54
53
44
48
36
32
50
58
104
20
34
28
120
116
62
110
112
126

70
128
67
118
66
12
88
64
124
92
80
86
60
130
100
72
18
84
16
95
94
78
64
102
98
102
90
82
14

WINKING APPARATUS FOR FIGURE TOY

DESCRIPTION

1. Technical Field

The present invention relates generally to figure toys and more particularly to a new and useful winking apparatus for dolls.

The play value of figure toys is sometimes enhanced by providing mechanisms for animating facial or body features. One such animating mechanism comprises mechanical eyes which may be moved from open to closed positions. Such mechanical eyes are sometimes referred to as "sleeping doll eyes".

2. Background Art

The prior art, U.S. Pat. Nos. 503,967 and 3,086,318, provided sleeping doll eyes having fixed eyeballs and movable eyelids mounted behind eye cavities provided in the doll's head. Weights are employed to automatically move the eyelids over the eyeballs when the doll is placed in a horizontal position and to automatically open the doll's eyes when it is returned to an upright position.

Additionally, U.S. Pat. No. 4,223,561, held by the Assignee of the present invention, discloses a motion translating mechanism in combination with a doll. This mechanism translates motion in a first direction to an output motion in a direction normal to the first direction. The mechanism includes a generally bar-shaped member with a second generally bar-shaped member slidably coupled thereto with an interconnecting pressure plate member operable toward the first bar-shaped member for sliding the second bar-shaped member. The pressure plate member is formed integrally with the first and second members and is spring-biased.

DISCLOSURE OF INVENTION

In accordance with the present invention, a new and useful winking apparatus is provided for animating figure toys. This apparatus includes a doll head having an outer surface and an inner surface, a simulated eye provided on said outer surface, an arcuate slot provided in said head above said simulated eye, a simulated eyelid is mounted in the slot with the eyelid having a first end positioned adjacent the outer surface of the head and a second end positioned adjacent the inner surface of the head, and a mechanism affixed to the second end of the simulated eyelash for moving the first end thereof between open positions and closed positions with respect to the simulated eye, whereby the doll may be caused to simulate winking actions.

The eyelash moving mechanism may include a first plate affixed to the second end of the simulated eyelid, a pivot swingably mounting the first plate to the head, a rod having a first end pivotally coupled to the first plate, an intermediate portion extending through the neck portion of the doll and a second end extending into the doll's torso. The eyelash moving mechanism may also include a motion translating mechanism generally of the type disclosed in U.S. Pat. No. 4,233,561. A second plate is carried by this mechanism and is provided with an elongated slot for receiving the second end of the rod. Stop members may then be provided on the second end of the rod above and below the second plate for transmitting motions from the second plate to the first plate. An aperture may be provided in this second plate in communication with the elongated slot to facilitate coupling the second end of the rod thereto by inserting the lower stop through the aperture and then sliding the rod into the slot. The first end of the rod may also be provided with stop members and the first plate may also be provided with a slot-and-aperture arrangement, if desired.

The features of the present invention which are believed to be novel are set forth with particularity in the appended claims. The present invention, both as to its organization and manner of operation, may best be understood by reference to the following description of the best mode for carrying out the invention, taken in connection with the accompanying drawings in which like reference characters refer to like elements in the several views.

BEST MODE FOR CARRYING OUT THE INVENTION

Figure 1:
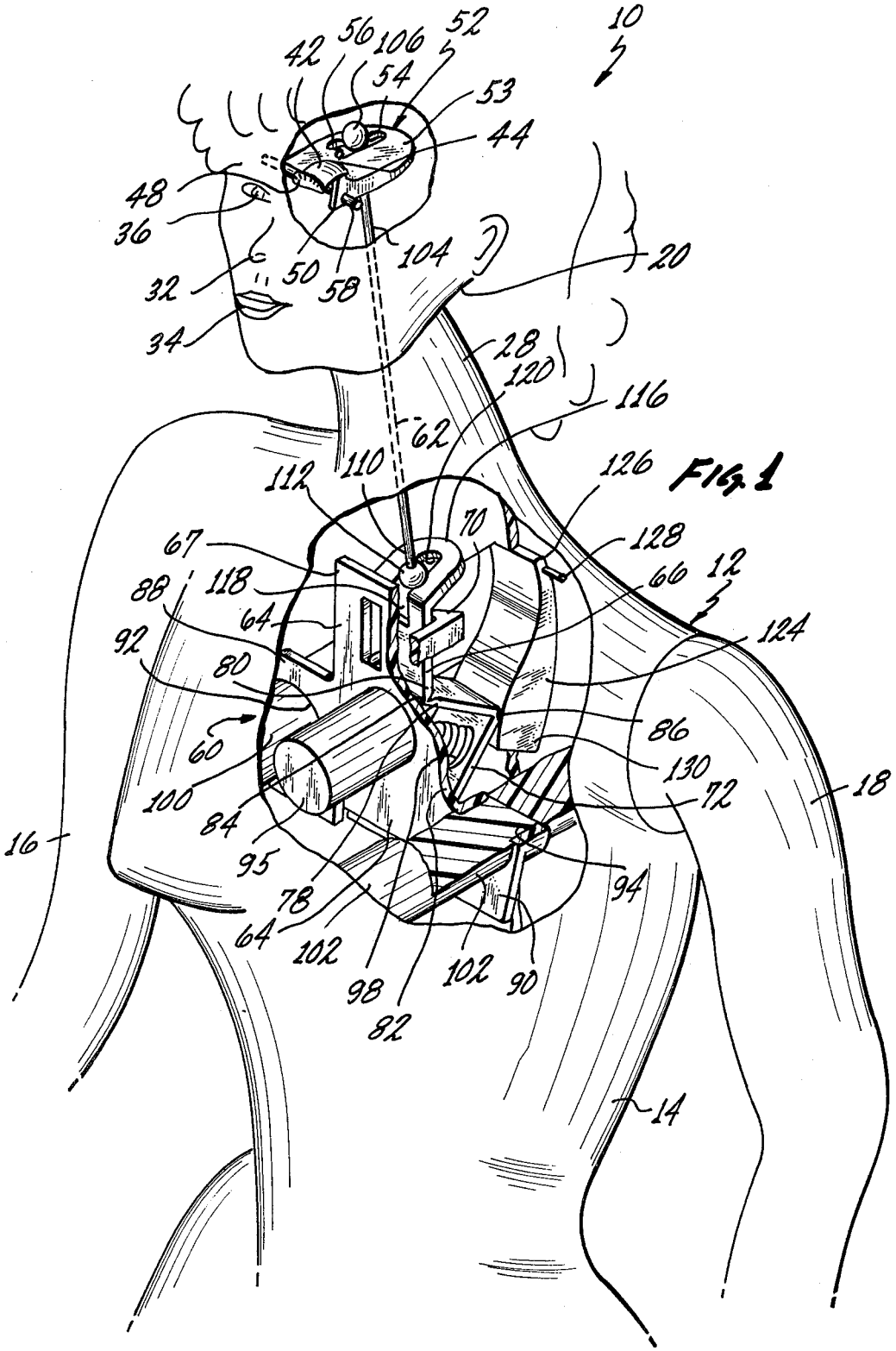
FIG. 1 is a partial perspective view, with parts broken away to show internal construction, of a figure toy incorporating the apparatus of the present invention.

Referring again to the drawings, a winking apparatus constituting a presently-preferred embodiment of the invention, generally designated 10, includes a figure toy or doll 12 having a torso 14, a pair of arms 16, 18 and a head 20.

Head 20 includes a skull 22 (FIGS. 2 and 3) from which a bulbous neck 24 depends into articulated engagement with a socket 26 forming the upper end of a torso neck-portion 28. Skull 22 and bulbous neck 24 and torso 14 and torso neck-portion 28, respectively, may be integrally molded from suitable polymeric materials.

Skull 22 may be covered with a soft vinyl skin 30 forming a nose 32 and a mouth 34. A pair of eyes 36, 38 may be provided on skin 30 by painting techniques or the like. An arcuate slot 40, which extends through skin 30 and skull 22, may be provided in head 20 above eye 38.

Winking apparatus 10 also includes a simulated eyelid 42 which is in the form of a sector of a sphere (FIG. 1) and which is movably mounted in slot 40 with a first end 44 inside skull 22 and a second end 46 outside skin 30. End 46 of eyelid 42 carries a simulated eyelash 48 and end 44 is carried by a vertical plate 50 forming part of an eyelid-mounting mechanism 52 including a horizontal plate 53 having an elongated slot 54 and an aperture 56 (FIG. 1) provided therein. Mechanism 52 is pivotally mounted to skull 22 by a pivot 58 and is connected to an actuating mechanism 60 by a force transmitter or rod 62.

Actuating mechanism 60 may be of the type disclosed and claimed in U.S. Pat. No. 4,223,561 wherein motion is translated in a first direction by an output motion in a direction normal to the first direction. Mechanism 60 includes a first elongated generally bar-shaped member 64, a second generally bar-shaped member 66 slidably coupled to the upper end 67 of the first member 64 by a pair of ways 68, 70 provided on the first member 64, and a deformable pressure plate 72 having a first end 74 hingedly coupled to the lower end 80 of the second member 66.

The first member 64, the second member 66 and the pressure plate 72 are portions of unitary generally rigid polymeric member having integral reduced cross section hinge portions 82, 84, 86 at the juncture of ends 74, 76 and 78, 80 and at an intermediate portion of plate 72, respectively. A pair of mounting plates 88, 90 are formed integrally with the lower end 76 of the first member 64 and are provided with apertures 92, 94 (FIG. 1), respectively. A cylindrical cavity 95 is also formed integrally with member 64 and a protuberance 96 is formed integrally with plate 72 adjacent hinge portion 86 for accomodating a compression spring 98 biasing plate 72 to the extended position shown in FIG. 2. Mechanism 60 may be mounted to torso 14 by a pair of pins 100, 102 extending through apertures 92, 94, respectively.

Rod 62 includes an upper end 104 provided with a first pair of spaced-apart spherical stops 106, 108 and a lower end 110 provided with a second pair of spaced-apart spherical stops 112, 114. Upper end 104 may be connected to plate 53 by inserting stop 106 through aperture 56 from the underside of plate 53 and then moving end 104 into slot 54. Lower end 110 may be connected to plate 116, which forms the upper end of the second member 66, by inserting stop 114 through an aperture 118 and then sliding end 110 into a slot 120, both of which are provided in plate 116. A pair of gusset plates, like the one shown at 122 in FIGS. 2 and 3, may be formed integrally with plate 116 and member 66 for reinforcing plate 116 on each side of step 114.

Figure 2:
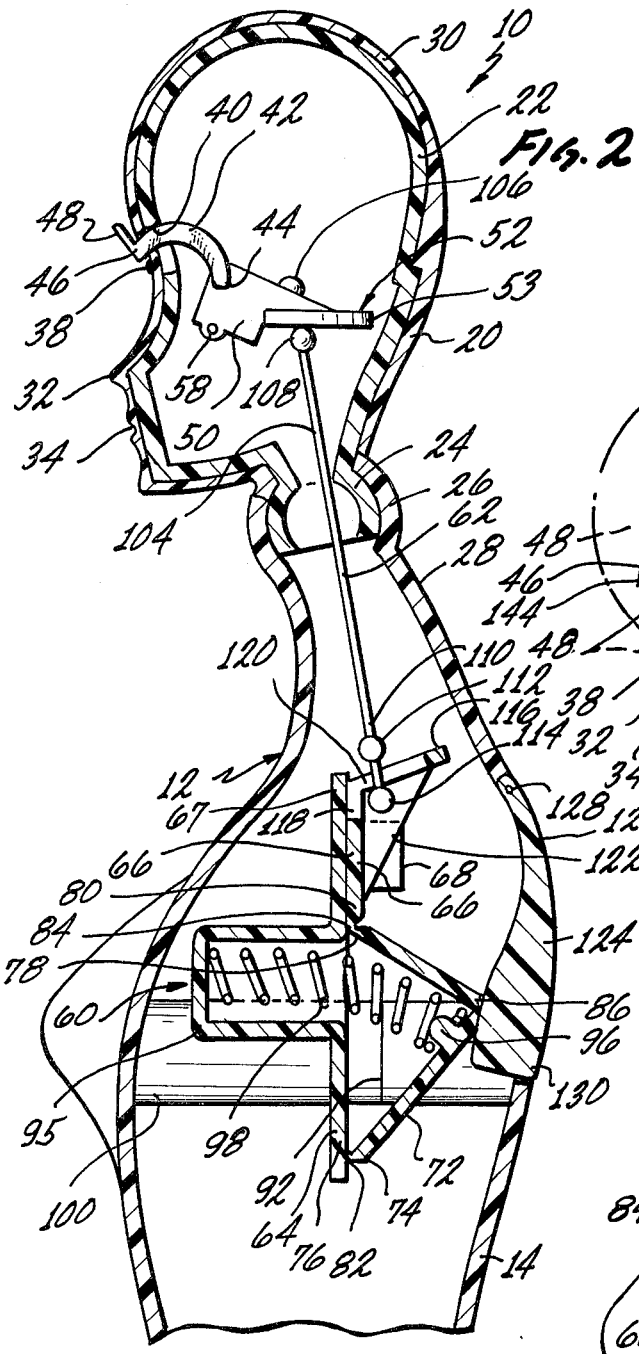
FIG. 2 is a vertical cross-sectional view of the figure toy of FIG. 1 showing the apparatus in a first operating position.

Actuating mechanism 60 may be actuated by a push plate 124 having an upper end 126 pivotally mounted to torso 14 by a pivot 128 and a lower end 130 engaging pressure plate 72 adjacent hinge portion 86. As best shown in FIG. 2, push plate 124 is biased by spring 98 and deformable plate 72 to a position where the outer surface of push plate 124 is flush with the outer surface of torso 14. In this position of push plate 144, deformable pressure plate 72 is fully extended along an axis normal to the major axis of member 66 which is in its lowermost position whereby the undersurface of plate 116 exerts a force on stop 114 causing rod 62 to pull stop 106 into engagement with the upper surface of plate 53 swinging vertical plate 50 clockwise about pivot 58 until simulated eyelash 48 bottoms out on skin 30 exposing simulated eye 38.

Figure 3:
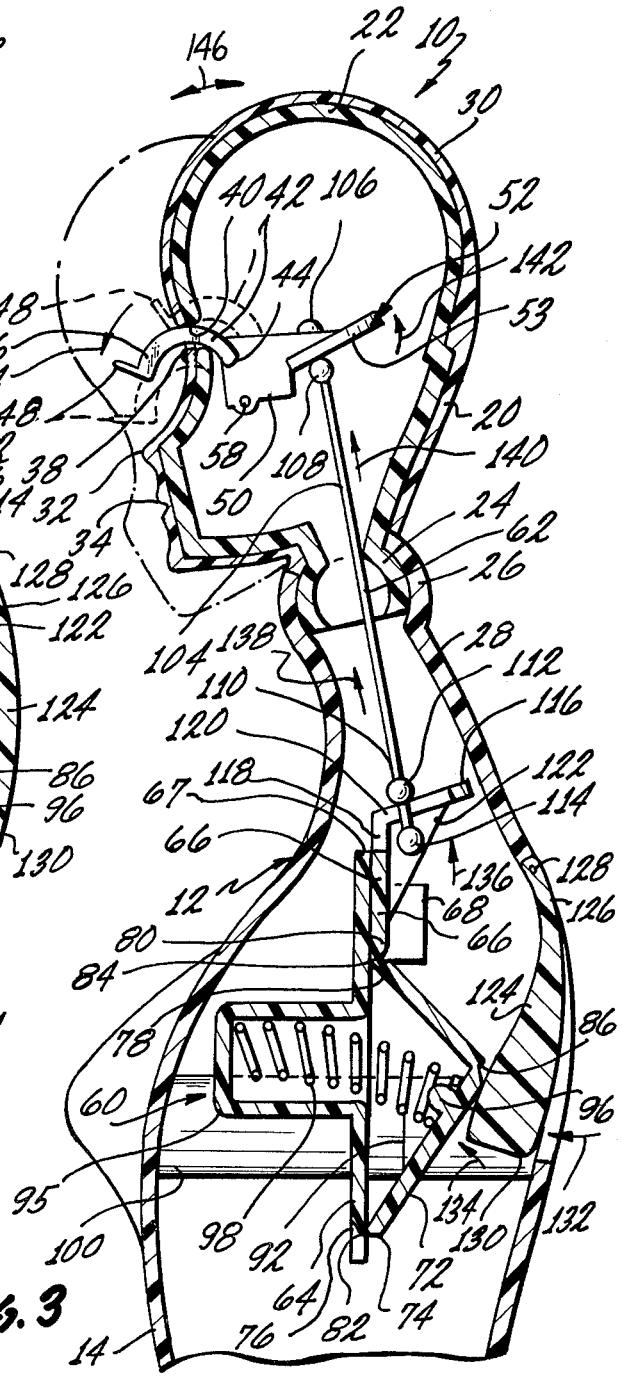
FIG. 3 is a view similar to FIG. 2 showing the apparatus in a second operating position.

Referring now to FIG. 3, operation of winking apparatus 10 is believed to be apparent from the foregoing and is briefly summarized at this point. Doll 12 may be made to wink its left eye by applying a force to push plate 126 in the direction of arrow 132. End 130 of plate 126 then causes the lower half of deformable plate 72 to pivot on hinge portion 82 in the direction of arrow 134 against the bias of spring 98 causing member 66 to slide upwardly in ways 68 in the direction of arrow 136. Upward movement of member 66 brings the upper end 116 thereof into engagement with stop 112 forcing rod 62 to move upwardly in the direction of arrows 138, 140. Upward movement of rod 62 brings stop 108 into engagement with the underside of plate 53 swinging it about pivot 58 counterclockwise in the direction of arrow 142. This causes vertical plate 50 to move simulated eyelid 42 outwardly and downwardly through slot 40 in the direction of arrow 144 from the upper broken line position to the solid line position. Continued pressure on plate 126 will then move simulated eyelid 42 to its lower broken line position completely covering eye 38. It will be apparent to those skilled in the art that the manipulation of plate 126 may be controlled in a manner such that many interesting winking motions may be imparted to simulated eyelid 42. Additionally, the articulated neck connection and the slots 54, 120 permit head 20 to be nodded, as indicated by arrow 146, and to be rotated about a vertical axis.

While the particular winking apparatus herein shown and described in detail is fully capable of attaining the objects and providing the advantages hereinbefore stated, it is to be understood that it is merely illustrative of the presently preferred embodiment of the invention and that no limitations are intended to the details of construction or design herein shown other than as defined in the appended claims, which form a part of this disclosure.

Whenever the term "means" is employed in these claims, this term is to be interpreted as defining the corresponding structure illustrated and described in this specification or the equivalent of the same.

We claim:

1. In combination with a figure toy of the type which includes a torso having a neck portion and a head having a neck portion connected to the neck portion of said torso, said head including a skull, a soft polymeric skin covering said skull and a pair of simulated eyes provided on said skin, the improvement which comprises:

(A) a socket provided on the neck portion of said torso;

(B) a bulbous configuration provided by the neck portion of said head, whereby said head and said torso may be articulately connected together for rotation with respect to each other;

(C) an arcuate slot provided in said head above at least one of said simulated eyes;

(D) a simulated eyelid mounted in said arcuate slot, said simulated eyelid having a first end disposed outside of said head and a second end disposed inside said skull;

(E) an eyelash affixed to said first end of said simulated eyelid;

(F) means affixed to said second end of said simulated eyelid for moving said simulated eyelid from a normally open position to a closed position with respect to at least one of said simulated eyes, whereby said figure toy may be made to simulate a winking action, said moving means including:

(i) a first plate affixed to said second end of said simulated eyelid;

(ii) a pivot swingably mounting said first plate to said skull;

(iii) a rod having a first end pivotally coupled to said first plate, an intermediate portion extending through said neck portions and a second end extending into said torso;

(iv) a motion-translating mechanism mounted to said torso, said motion-translating mechanism including a second plate having an elongated slot provided therein, said second end of said rod being received within said elongated slot; and (v) first and second stop members affixed to said second end of said rod above and below said second plate, respectively, whereby said rod will transmit motions from said motion-translating mechanism to said first plate regardless of the amount said head is rotated with respect to said torso.

* * * * *